United States Patent [19]

Yatsunami et al.

[11] Patent Number: 4,609,024

[45] Date of Patent: Sep. 2, 1986

[54] PNEUMATIC RADIAL TIRE CORD FOR BELT

[75] Inventors: Joji Yatsunami, Tokyo; Tamio Araki, Fuchu, both of Japan

[73] Assignee: Bridgestone Corporation, Tokyo, Japan

[21] Appl. No.: 729,779

[22] Filed: May 2, 1985

[30] Foreign Application Priority Data

May 8, 1984 [JP] Japan ..... 59-66023[U]

[51] Int. Cl.[4] ..... D07B 1/06; B60C 9/00

[52] U.S. Cl. ..... 152/527; 57/212; 57/902

[58] Field of Search ..... 152/527, 451, 556; 57/902, 212, 213

[56] References Cited

U.S. PATENT DOCUMENTS

| | | | |
|---|---|---|---|
| 3,032,963 | 5/1962 | Fennen | 152/527 |
| 3,538,702 | 11/1970 | Wolf et al. | 52/212 |
| 3,996,733 | 12/1976 | Holmes | 57/212 |
| 4,158,946 | 6/1979 | Bourgoiv | 57/902 |
| 4,258,543 | 3/1981 | Canevari et al. | 152/451 |
| 4,509,318 | 4/1985 | Toneda | 57/212 |

*Primary Examiner*—Michael Ball

*Attorney, Agent, or Firm*—Sughrue, Mion, Zinn, Macpeak, and Seas

[57] ABSTRACT

A pneumatic radial tire comprising a radial carcass and a belt superimposed about a crown of the carcass is disclosed. In this tire, the cord for the belt is a metallic cord comprising a core of two metallic wires and an outer layer of six metallic wires disposed about the core, all of these wires having the same diameter and twisting direction and a form ratio of 90~110%.

2 Claims, 2 Drawing Figures

PNEUMATIC RADIAL TIRE CORD FOR BELT

BACKGROUND OF THE INVENTION

1. Field of the Invention

This invention relates to a pneumatic radial tire comprising a carcass of a radial structure and a belt superimposed about a crown of the carcass and embedded in a tread rubber. In particular this invention relates to an improvement in the pneumatic radial tire using metallic cords, particularly steel cords as a main reinforcing element for the belt, which advantageously and largely enhances the service life of the tire by improving the buckling fatigue resistance and corrosion resistance of the metallic cord.

2. Description of the Prior Art

The metallic cord of this type closest to the invention, are steel cords each comprising a core of two equal diameter metallic wires and an outer layer of six equal diameter metallic wires disposed about the core, the diameter of the outer layer wires being generally about 1.23~1.43 times the diameter of the core wires. Such are described in U.S. Pat. No. 3,996,733.

The inventors have made studies with respect to such steel cords used in a belt layer of a radial tire and confirmed that the buckling fatigue resistance and corrosion resistance are not sufficiently ensured in this steel cord. At present, it is strongly demanded to further improve steel cords.

Also, there have hitherto been known steel cords for use in the radial tire each comprising a core of two equal diameter metallic wires twisted with each other, an outer layer of seven equal diameter metallic wires twisted about the core in the same twisting direction as in the core wires and a spiral wrap of a single metallic wire twisted therearound. However, this steel cord still has insufficient buckling fatigue resistance and corrosion resistance likewise the aforementioned case.

The serious drawback of the steel cord according to the aforementioned U.S. Pat. No. 3,996,733 results from such a different diameter structure where the diameter of the outer layer wire is about 1.23~1.43 times the diameter of the core wire.

Concerning buckling fatigue resistance as a characteristic particularly required in the belt of the radial tire, it has been found that the buckling fatigue resistance and corrosion resistance considerably lower as the ratio in the diameter of the outer layer wire to the core wire becomes larger. This results from the conspicuous buckling repeatedly produced in the cornering and the like during the running of the radial tire. When buckling is produced in the steel cords as a reinforcing element for the belt, the maximum strain of the buckling is naturally given to the metallic wire in the outermost layer of the steel cord. Consequently, as the diameter of the metallic wire in the outermost layer becomes large, the maximum strain increases to reduce the life of the buckling fatigue resistance.

Further, as the ratio in diameter of the outer layer wire to the core wire increases, the space between the metallic wires constituting the outer layer reduces and consequently the penetrability of rubber constituting a belt layer to the inside of the steel cord lowers considerably. As a result, the rubber coating ratio on the core of the steel cord is also reduced, so that there is considerably increased the corrosion of the steel cord due to penetrated water during the running of the radial tire for a long time or water penetrating through tread cuts produced by treading on sharp rocks or through a nail penetrated into the tread.

SUMMARY OF THE INVENTION

The inventors have made various studies in order to solve the aforementioned problems of the prior art and found that the buckling fatigue resistance and corrosion resistance of the metallic cord can be improved by optimizing the diameter and form ratio of each of the core wire and the outer layer wire.

The invention is based on the above knowledge and is to not only prevent the reduction of the service life of the radial tire when using the metallic cords, exemplarily steel cords as the reinforcement for the belt but also largely enhance such a service life.

According to the invention, there is provided in a pneumatic radial tire comprising a carcass of a radial cord structure and a belt of cord structure superimposed about a crown of the carcass, the improvement wherein the cord for the belt is a metallic cord comprising a core of two metallic wires and an outer layer of six metallic wires disposed about the core, all of the metallic wires having the same diameter and twisting direction and a form ratio of 90~110%.

DESCRIPTION OF THE PREFERRED EMBODIMENTS

Figure 1:
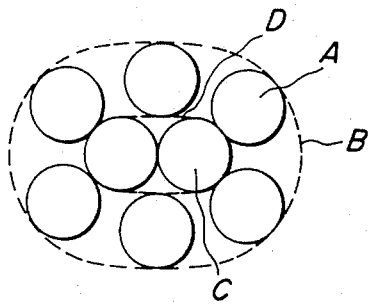
FIG. 1 is a schematically sectional view of an embodiment of the metallic cord according to the invention.

In FIG. 1 is sectionally shown an embodiment of the metallic cord according to the invention, wherein A is a metallic wire for an outer layer, B an outer layer, C a metallic wire for a core, and D a core. The two metallic wires C each having a circular section are twisted with each other to form the core D of the cord. On the other hand, the six metallic wires A each having a circular section are spirally twisted about the core to form the outer layer B. In this case, the core wires and the outer layer wires are twisted in the same twisting direction, so that the fatigue properties become excellent as compared with the case of twisting the core wires and the outer layer wires in different twisting directions.

All of the two core wires and the six outer layer wires have the same diameter.

If the diameter of the core wires is larger than that of the outer layer wires, the space between the outer layer wires is too wide and it is difficult to stably perform the uniformly spiral twisting of the outer layer wires, and consequently the biasing between the outer layer wires is caused to considerably reduce the buckling fatigue resistance.

Figure 2:
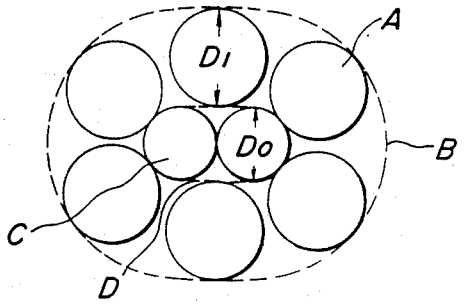
FIG. 2 PRIOR ART
FIG. 2 is a schematically sectional view of the conventional metallic cord.

On the other hand, if the diameter of the core wires ($D_0$) is smaller than that of the outer layer wires ($D_1$) as shown in FIG. 2 (e.g. $D_1/D_0=1.33$), the space between the outer layer wires becomes narrower and rubber can not sufficiently penetrate into the inside of the cord and the coating of the core wires with rubber is insufficient, so that the corrosion resistance is reduced considerably due to penetrated water and the buckling fatigue resistance lowers.

As a result of experiments, it has been confirmed that the buckling fatigue resistance can remarkably be enhanced by limiting the form ratio of each of the core wires and outer layer wires to a range of 90~110%.

EXAMPLE

A pneumatic radial tire for a passenger car with a size of P 195/75 R14 comprising a carcass of two polyester fiber cord plies was manufactured by using steel cords each composed of two cord wires and six outer layer wires as shown in the following Table 1, and then evaluated with respect to the buckling fatigue resistance and corrosion resistance.

The evaluation was performed as follows, provided that the test tire No. 3 of Table 1 was a control tire.

In test tire Nos. 1 and 2, there were used steel cords of (2+7)+1 structure; wherein 7 outer layer wires were twisted around a core of two twisted core wires in the same twisting direction as in the core and further a single steel filament wire was twisted therearound as an outermost layer. Rubben penetrability:

After a cord sample was taken out from the test tire and then all outer layer wires were removed from the cord sample, the length of the core coated with rubber was measured by means of a magnifying glass, from which the rubber penetrability was calculated according to the following equation:

$$\text{Rubber penetrability} = \frac{\text{Length coated with rubber}}{\text{Length of cord sample}} \times 100$$

Form ratio:

(1) Steel filament wire for outer layer

The maximum diameter (L) of the steel cord (outer layer) was measured by means of a magnifying glass. Thereafter, the outer layer wire was taken out from the cord without being subjected to permanent deformation and then its maximum wave height (l) was measured by means of the magnifying glass. Next, the form ratio of the outer layer wire was calculated according to the following equation:

$$\text{Form ratio} = l/L \times 100\ (\%)$$

(2) Steel filament wire for core

After all outer layer wires were removed from the steel cord, the maximum diameter (L) of the remaining core was measured, and then the core wire was taken out from the core and its maximum wave height (l) was measured by means of a magnifying glass, from which the form ratio was calculated according to the following equation:

$$\text{Form ratio} = l/L \times 100\ (\%).$$

TABLE 1

| | Prior Art | | | | | Comparative Example | | Example | | |
|---|---|---|---|---|---|---|---|---|---|---|
| Test tire No. | 1 | 2 | 3 | 4 | 5 | 6 | 7 | 8 | 9 | 10 |
| Cord structure | (2 + 7) + 1 | (2 + 7) + 1 | 2 + 6 | 2 + 6 | 2 + 6 | 2 + 6 | 2 + 6 | 2 + 6 | 2 + 6 | 2 + 6 |
| Diameter of steel filament wire in core (mm) | 0.220 | 0.220 | 0.200 | 0.200 | 0.175 | 0.230 | 0.230 | 0.230 | 0.230 | 0.230 |
| Diameter of steel filament wire in outer layer (mm) | 0.220 | 0.220 | 0.240 | 0.240 | 0.245 | 0.230 | 0.230 | 0.230 | 0.230 | 0.230 |
| Diameter of steel filament wire in spiral wrap (mm) | 0.15 | 0.15 | — | — | — | — | — | — | — | — |
| Twisting pitch of core (mm) | 6.0 | 6.0 | 6.0 | 6.0 | 6.0 | 6.0 | 6.0 | 6.0 | 6.0 | 6.0 |
| Twisting pitch of outer layer (mm) | 12.0 | 12.0 | 12.0 | 12.0 | 12.0 | 12.0 | 12.0 | 12.0 | 12.0 | 12.0 |
| Twisting pitch of spiral wrap (mm) | 3.5 | 3.5 | — | — | — | — | — | — | — | — |
| Form ratio of core wires (%) | 85 | 101 | 83 | 99 | 80 | 82 | 117 | 93 | 98 | 110 |
| Form ratio of outer layer wires (%) | 82 | 105 | 80 | 102 | 75 | 78 | 108 | 91 | 101 | 108 |
| Form ratio of spiral wrap wire (%) | 105 | 102 | — | — | — | — | — | — | — | — |
| Results | | | | | | | | | | |
| Rubber penetrability (%) | 58 | 62 | 73 | 69 | 25 | 90 | 93 | 91 | 93 | 92 |
| Corrosion resistance (index) | 90 | 90 | 100 | 100 | 30 | 150 | 150 | 150 | 150 | 150 |
| Buckling fatigue resistance (index) | 70 | 95 | 100 | 120 | 50 | 120 | 115 | 130 | 150 | 140 |

As apparent from the results of Table 1, the use of steel cord having the same diameter structure develops excellent buckling fatigue resistance and corrosion resistance as compared with the case of steel cord having the different diameter structure. Furthermore, it is obvious that the buckling fatigue resistance is considerably enhanced by restricting the form ratio of the steel filament wire to 90~110%.

As mentioned above, according to the invention, the service life of the radial tire can significantly be improved by using metallic cords having improved buckling fatigue resistance and corrosion resistance as at least a part of the reinforcement for the tire.

What is claimed is:

1. In a pneumatic radial tire comprising a carcass of a radial cord structure and a belt of cord structure superimposed about a crown of the carcass, the improvement wherein the cord for the belt is a metallic cord comprising a core of two metallic wires and an outer layer of six metallic wires disposed about the core, all of said metallic wires having the same diameter and twisting direction and a form ratio of 90~110%.

2. The pneumatic radial tire according to claim 1, wherein said metallic wire is a steel filament wire.

* * * * *